US005267499A

United States Patent [19]

Othon

[11] Patent Number: 5,267,499

[45] Date of Patent: Dec. 7, 1993

[54] METHOD OF ENHANCING AND MODIFYING THE VISUAL AND AURAL CHARACTERISTICS OF A STRINGED INSTRUMENT

[76] Inventor: Robert S. Othon, 8838 Greenback La., Ste. B, Orangevale, Calif. 95662

[21] Appl. No.: 959,785

[22] Filed: Oct. 13, 1992

[51] Int. Cl.[5] ..... G10D 3/00

[52] U.S. Cl. ..... 84/291; 51/283 R; 51/323

[58] Field of Search ..... 84/275, 291; 125/1, 125/15, 25; 51/3, 5 B, 5 C, 283 R, 323

[56] References Cited

U.S. PATENT DOCUMENTS

| | | | |
|---|---|---|---|
| 3,769,871 | 11/1973 | Cawthorn | 84/291 |
| 4,919,029 | 4/1990 | Excellente | 84/291 |
| 5,004,512 | 4/1991 | Fodera | 125/1 X |
| 5,056,272 | 10/1991 | Battaglia | 51/283 R |
| 5,078,815 | 1/1992 | Othon | 156/63 |

*Primary Examiner*—Michael L. Gellner
*Assistant Examiner*—P. Stanzione
*Attorney, Agent, or Firm*—Thomas R. Lampe

[57] ABSTRACT

A method of enhancing and modifying the visual and aural characteristics of a stringed instrument wherein the flat surfaces of a stone and the body of a stringed instrument are adhesively secured together. The stone is worked while the stone is bonded to the instrument to reduce the thickness of the stone and produce a stone laminate.

12 Claims, 3 Drawing Sheets

METHOD OF ENHANCING AND MODIFYING THE VISUAL AND AURAL CHARACTERISTICS OF A STRINGED INSTRUMENT

TECHNICAL FIELD

This invention relates to the manufacture of a stringed instrument, for example, a guitar. More particularly, the method of the present invention is for the purpose of enhancing and modifying the visual and aural characteristics of the stringed instrument.

BACKGROUND ART

It is well known that resonance and tone of guitars and the like are greatly affected by the types of materials employed in the construction of the instruments. This is true not only with regard to acoustic instruments but electric instruments as well.

A variety of laminate and coating types have been employed with respect to stringed instruments to obtain a desired sound as well as to render the instrument more attractive in appearance.

According to the teachings of the present invention, natural rock or stone is employed as a laminate on a stringed musical instrument to not only modify the aural and resonance characteristics thereof but also to add to its beauty. The stone employed may be extremely dense and hard, extremely soft (soapstone being an example), or anywhere in between in order to provide the desired effect. An extremely hard rock, for example, will give the musical instrument great sustain properties. A softer rock or stone, on the other hand, may be used to affect the sound in other ways, such as "softening" the tone and resonance. When the stone laminate is positioned at the pick guard of an electric stringed instrument, the aural characteristics are affected due to shielding of the instrument's electronic components.

Utilizing the teachings of the present invention, virtually any type of stone may be applied to a string instrument and utilized therewith. The stone laminate is adhesively secured to a stringed instrument and becomes an integral part thereof.

It is of course known to utilize rock and stone as decorative laminates. For example, my U.S. Pat. No. 5,078,815, issued Jan. 7, 1992, discloses a method of making a decorative transparent laminate comprised of a thin layer of stone bonded by an adhesive to a transparent, rigid substrate material. The stone is bonded to a transparent sheet of glass by adhesive and then worked to provide the desired decorative effect. There is, however, no suggestion in U.S. Pat. No. 5,078,815 of the concept of utilizing a stone laminate as a medium for enhancing and modifying the visual and aural characteristics of a stringed instrument.

DISCLOSURE OF INVENTION

According to the method of the present invention a stone is worked to form a substantially flat surface thereon. Adhesive is then applied to said substantially flat surface and/or a substantially flat surface of a stringed instrument which is adjacent to the locations of the strings of the instrument.

The substantially flat surfaces of the stone and the instrument are then positioned together with the adhesive therebetween at the juncture of the substantially flat surfaces. After the positioning step, the substantially flat surfaces of the stone and the instrument are bonded together.

After the bonding step, the stone is further worked while it is bonded to the instrument to reduce the thickness of the stone. In a preferred embodiment of the invention, the step of further working the stone includes cutting the stone in a cutting plan substantially parallel to the plane defined by the juncture of the stone's substantially flat surface and the instrument's substantially flat surface.

In some cases, the instrument may define at least one recess extending inwardly from the substantially flat surface of the instrument. The recess may, for example, comprise the opening to the interior of an acoustic guitar. In any event, the method may include the additional step of cutting an opening in the stone after the thickness of the stone has been reduced, the opening communicating with the recess.

Other features, advantages, and objects of the present invention will become apparent with reference to the following description and accompanying drawings.

MODES FOR CARRYING OUT THE INVENTION

Figure 1:
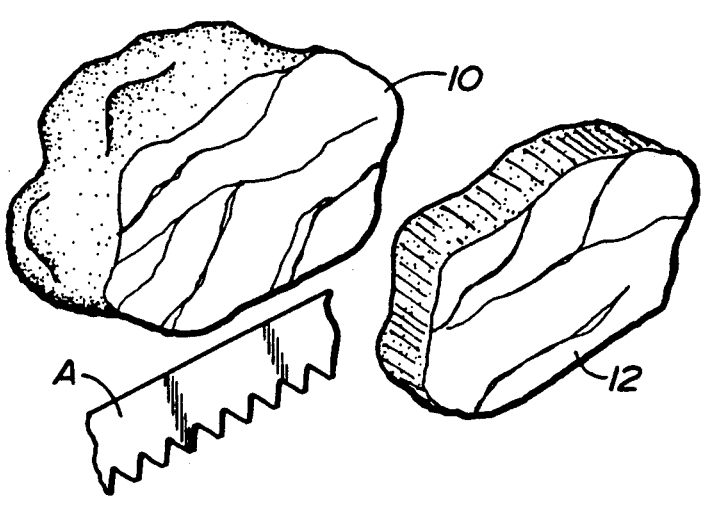
FIG. 1 is a perspective view of a large stone which has been cut to form two separate stones, each of which has at least one substantially flat surface thereon.

Referring now to the drawings, FIG. 1 shows an initial step carried out when practicing the method of the present invention. In FIG. 1 a parent stone or rock has been cut by saw A into two separate stones 10 and 12, both of which have at least one substantially flat surface thereon. Stone 12 is in the form of a slab having two substantially flat surfaces and the slab is of sufficient thickness to maintain its structural integrity when being transported. This will, of course, vary depending upon the type of stone, the softer stones such as soapstone, sandstone or the like normally requiring a greater thickness to prevent breakage.

In the embodiment illustrated in FIGS. 1–7 and 9, the stone 12 will be used as a facing or laminate on an electrical guitar body and will cover the entire expanse of an outer surface thereof. Dash line 14 (FIG. 5) delineates the final shape of an acoustic guitar body which will be formed from a single block of wood 16 and the slab 12 in this instance entirely covers the area defined by dash line 14. The upper or top surface of the wood block 16 is substantially flat and said surface is designated by reference numeral 18.

Adhesive is applied to either substantially flat surface 18 or one of the substantially flat surfaces of slab 12, or both of these surfaces. The adhesive may be any desired type, for example, carpenter's glue or an epoxy glue.

Figure 2:
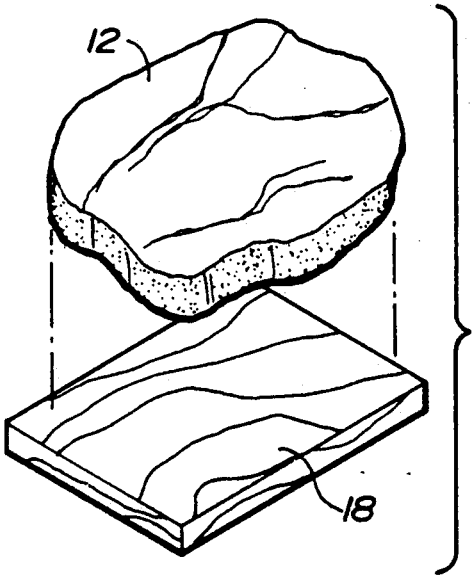
FIG. 2 is a perspective view illustrating one of the stones of FIG. 1 prior to its application to a block of wood.
Figure 3:
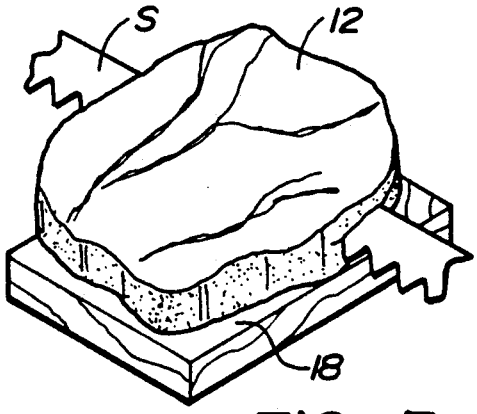
FIG. 3 is a perspective view of the stone secured to the block of wood and the stone being cut.
Figure 4:
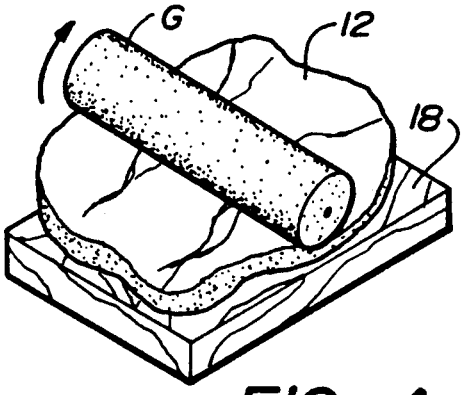
FIG. 4 is a perspective view of the cut stone being worked to decrease the thickness of the stone.

Now the stone 12 and the block of wood 16 are positioned together, as illustrated in FIG. 2, so that one of the substantially flat surfaces of the stone 12 is located on surface 18 of the block of wood, as shown in FIG. 3. The adhesive is pressed therebetween at the juncture of the substantially flat surfaces.

After stone 12 and block of wood 16 are bonded together by the adhesive, bonding time of course depending upon the nature of the adhesive, slab 12 is sawn or cut in a cutting plane substantially parallel to the plane defined by the juncture of the stone substantially flat surface and surface 18. This step is shown in FIG. 3. Sawing considerably reduces the thickness of the stone bonded to the block of wood 16; however, fracture or damage thereto is prevented because the remaining stone and the block of wood are essentially an integral unit, the components being held together by adhesive. All stone has voids formed therein to some degree and structural integrity of the stone is enhanced because the adhesive has been impressed into such voids.

The stone on block 16 is now further worked to reduce the thickness thereof to the desired degree. This is normally accomplished by using a cylindrically-shaped grinder G (FIG. 4); however, other tools may be utilized for such purpose, such as lapping disks.

Figure 5:
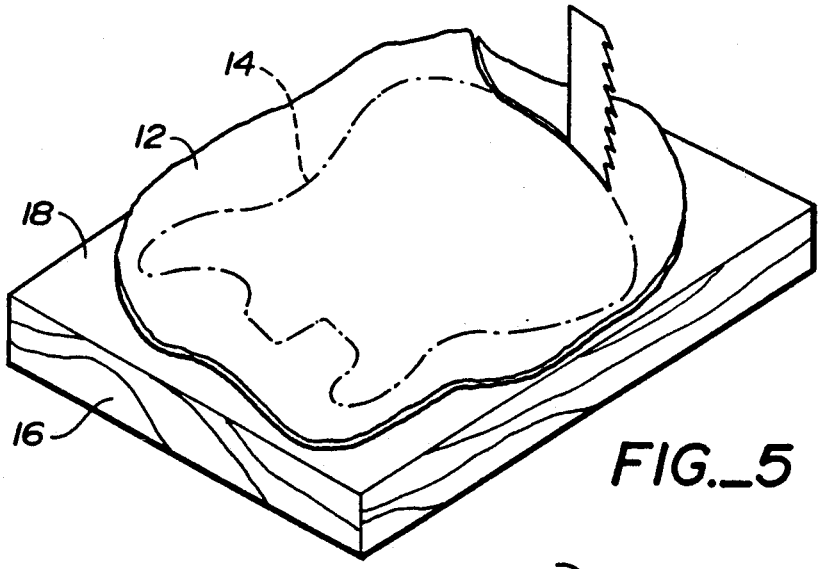
FIG. 5 is a perspective view of the stone and block being sawn to shape the body of a stringed instrument.

When the stone has been worked to the desired thinness, the block and stone may be cut jointly by a band saw or other type of saw as shown in FIG. 5 to form the laminated body 20 (FIG. 6) of the musical instrument being manufactured. FIG. 5 illustrates a typical configuration of a body for an electric guitar; however, it will be appreciated that the principles of the present invention may be applied to any stringed instrument body shape and type, both electric and acoustic. The outer peripheral wall of body 20 is designated by reference numeral 22.

Figure 6:
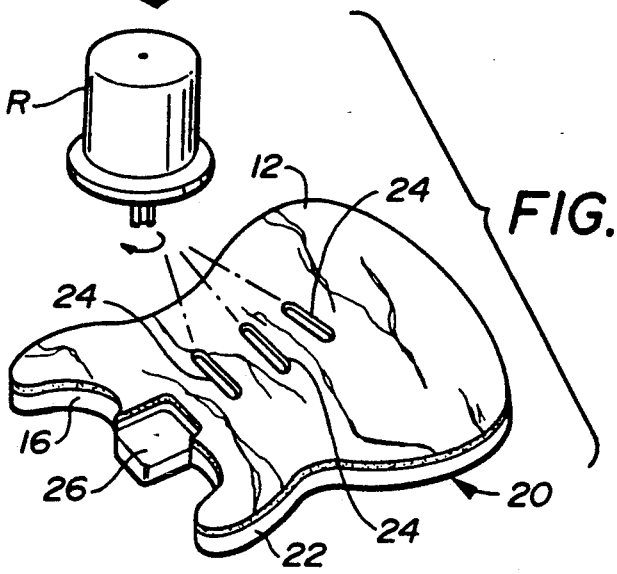
FIG. 6 is a perspective view showing a router and stringed instrument body, the router having been utilized to form recesses in the stringed instrument body.

FIG. 6 shows another step of the present method. The laminated body, as is conventional, must be adapted to accommodate pickups (not shown) customarily employed in connection therewith. For this purpose a suitable tool such as a router R is employed a shown in FIG. 6 to simultaneously cut an opening in the stone laminate and a recess in the wood component of the laminated body 20 in substantially registry with the opening. In FIG. 6 three such recesses 24 are shown in communication with holes or openings of the same shapes formed in the stone laminate.

Figure 7:
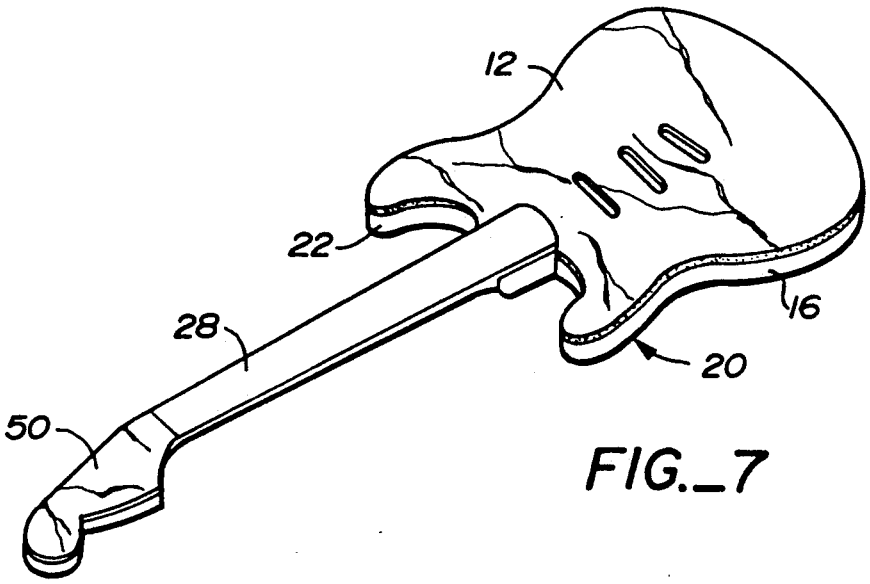
FIG. 7 is a perspective view of a stringed instrument body combined with an elongated neck.

The laminated body 20 shown in FIG. 6 has also been machined or worked to provide an indented segment 26 to which the elongated neck of the finished guitar is connected. FIG. 7 shows a neck 28 so attached. Attachment may be accomplished in any suitable conventional manner, most commonly by mechanical fasteners (not shown).

Figure 9:
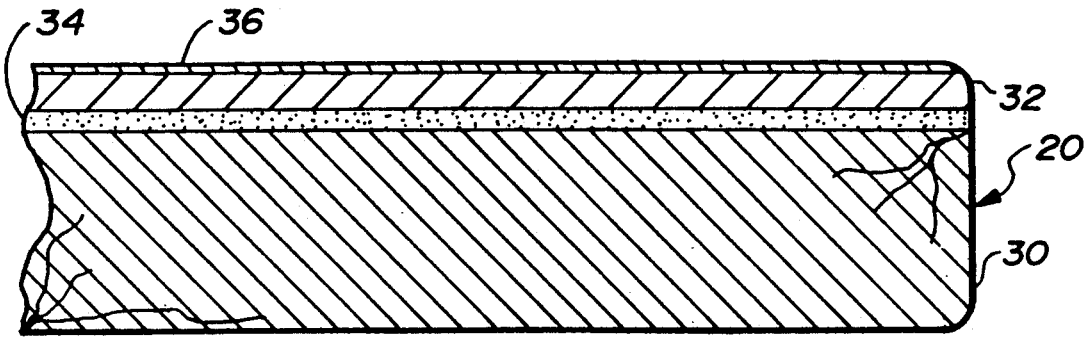
FIG. 9 is a greatly enlarged cross-sectional view of a laminate produced in accordance with the teachings of the present invention.

The stone facing or laminate of the laminated stringed instrument body 20 may be further treated to provide a desired effect. For example, the stone laminate may be polished or a protective coating such as clear urethane may be applied thereto. FIG. 9 is a greatly enlarged cross section of a portion of the laminated body 20. The particular laminate disclosed includes the wood body portion 30 (formed from block 16), a stone laminate 32 (formed from stone 12), adhesive 34 bonding the stone and wood together, and an epoxy coating 36.

Figure 8:
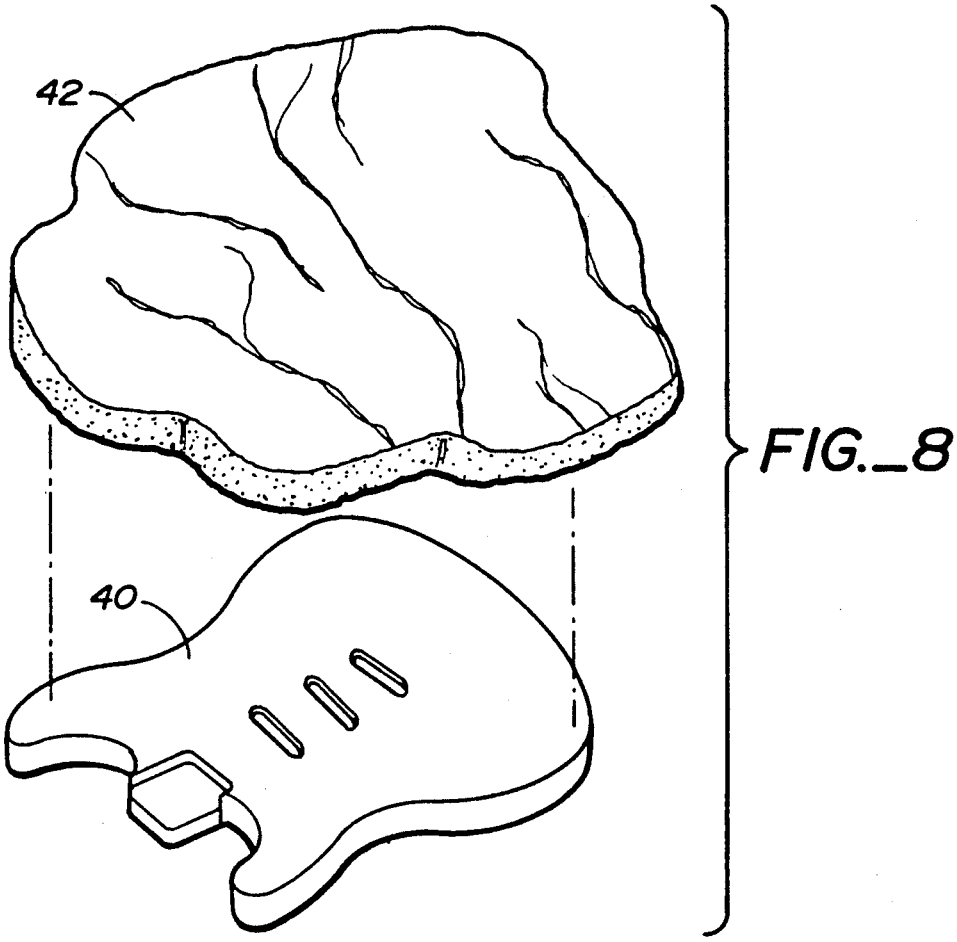
FIG. 8 is a perspective view of a stringed instrument body and stone being applied thereto during the step of an alternative method of the present invention.

FIG. 8 illustrates an alternative step which may be employed in the manufacture of a stringed instrument utilizing the teachings of the present invention. Here, the wood body portion 40 of the instrument body has been precut to the desired shape and the desired recesses and indented segment have been formed therein prior to formation of the wood-stone laminate. A stone 42 is adhesively secured into position in the manner previously described with reference to stone 12. The stone 42 is then cut and further worked to the desired thinness in the manner indicated above. Of course, this occurs after a bond has formed between the stone 42 and the wood body portion 40.

Now the stone 42 is cut, either manually or by machine so that it has the desired peripheral shape and defines openings corresponding to recesses previously formed in the wooden body portion 40 in order to ensure that the openings in the stone laminate correspond to such recesses. A template (not shown) may be utilized to ensure precise registration of the recesses and holes. This is particularly useful when the worked stone is still opaque.

Although the embodiments described above utilize a stone laminate which covers an entire stringed instrument body, it will be appreciated that the teachings of the invention may also be utilized when a partial stone laminate covering only a predetermined segment of the wood body portion is desired. Furthermore, the stone laminate need not bee secured to the body. For example, a stone laminate may be applied to a portion of the instrument neck. FIG. 7 shows a stone laminate 50 at the distal end of the neck.

I claim:

1. A method of enhancing and modifying the visual and aural characteristics of a stringed instrument having a substantially flat surface adjacent to the locations of the strings of said instrument, said method comprising the steps of:

working a stone to form a substantially flat surface on said stone;

applying an adhesive to at least one of said substantially flat surfaces;

positioning together the substantially flat surfaces of said stone and said instrument with said adhesive therebetween at the juncture of said substantially flat surfaces;

after said positioning step, bonding together the substantially flat surfaces of said stone and said instrument with said adhesive;

after said bonding step, further working said stone while said stone is bonded to the instrument to reduce the thickness of said stone.

2. The method according to claim 1 wherein the step of further working said stone includes cutting the stone in a cutting plane substantially parallel to the plane defined by the juncture of said stone substantially flat surface and said instrument substantially flat surface.

3. The method according to claim 2 wherein said step of further working said stone includes grinding the stone after the stone has been cut in said cutting plane.

4. The method according to claim 1 wherein said instrument defines at least one recess extending inwardly from the substantially flat surface of said instrument and wherein said recess is covered by said stone during said positioning step, said method including the additional step of cutting an opening in said stone after the thickness of said stone has been reduced, said opening communicating with said recess.

5. The method according to claim 4 wherein said opening is cut along a line of cut substantially corresponding to the shape of the outer periphery of said recess at said instrument substantially flat surface.

6. The method according to claim 2 wherein said instrument has a peripheral side wall, said method including the additional step of conforming the shape of said stone to the shape of at least some of said instrument peripheral side wall.

7. The method according to claim 6 wherein said confining step is carried out by simultaneously sawing both said stone and said instrument in a direction generally perpendicular to said cutting plane.

8. The method according to claim 1 wherein said stone defines voids, said method including filling at least some of said voids with adhesive prior to said bonding step.

9. The method according to claim 1 including the step of applying a protective coating to said stone after further working of said stone.

10. The method according to claim I wherein said instrument is a guitar and wherein said stone is adhesively secured to the body of said guitar.

11. The method according to claim 1 including the additional step of cutting at least one opening in the stone after the thickness of the stone has been reduced.

12. The method according to claim 11 wherein a recess is cut into s id instrument while cutting said at least one opening, said recess and said at least one opening being in substantial registry.

* * * * *